US006502724B1

(12) United States Patent
Kelpach

(10) Patent No.: US 6,502,724 B1
(45) Date of Patent: Jan. 7, 2003

(54) BEVERAGE DISPENSING SYSTEM

(76) Inventor: Harry Kelpach, 19791 Bahama St., Northridge, CA (US) 91324

( * ) Notice: Subject to any disclaimer, the term of this patent is extended or adjusted under 35 U.S.C. 154(b) by 0 days.

(21) Appl. No.: 09/971,138

(22) Filed: Oct. 3, 2001

(51) Int. Cl.[7] ..... B67D 5/62
(52) U.S. Cl. ..... 222/146.6; 285/334.4
(58) Field of Search ..... 222/146.6, 570, 222/573, 132; 285/334.4

(56) References Cited

U.S. PATENT DOCUMENTS 4,674,296 A 6/1987 Renaud
5,305,924 A * 4/1994 Groover et al. ..... 137/377
5,884,813 A * 3/1999 Bordonaro et al. ..... 137/884

* cited by examiner

*Primary Examiner*—Philippe Derakshani
*Assistant Examiner*—Melvin A Cartagena
(74) *Attorney, Agent, or Firm*—J. E. Brunton

(57) ABSTRACT

A connector module for use in connection with a beverage dispensing system for dispensing a beverage from a beverage container that includes a surface mounted dispensing tower to which one or more dispensing faucets are connected. The connector module can be inserted directly into the dispensing tower and take the place of the existing feed lines and cooling means. Additionally, the connector module which can be operably interconnected with the dispensing faucets, includes a cooling component that can be connected to the feed line and to a refrigeration line for cooling the feed line so as to ensure that the beverage leaving the faucet is appropriately chilled.

17 Claims, 10 Drawing Sheets

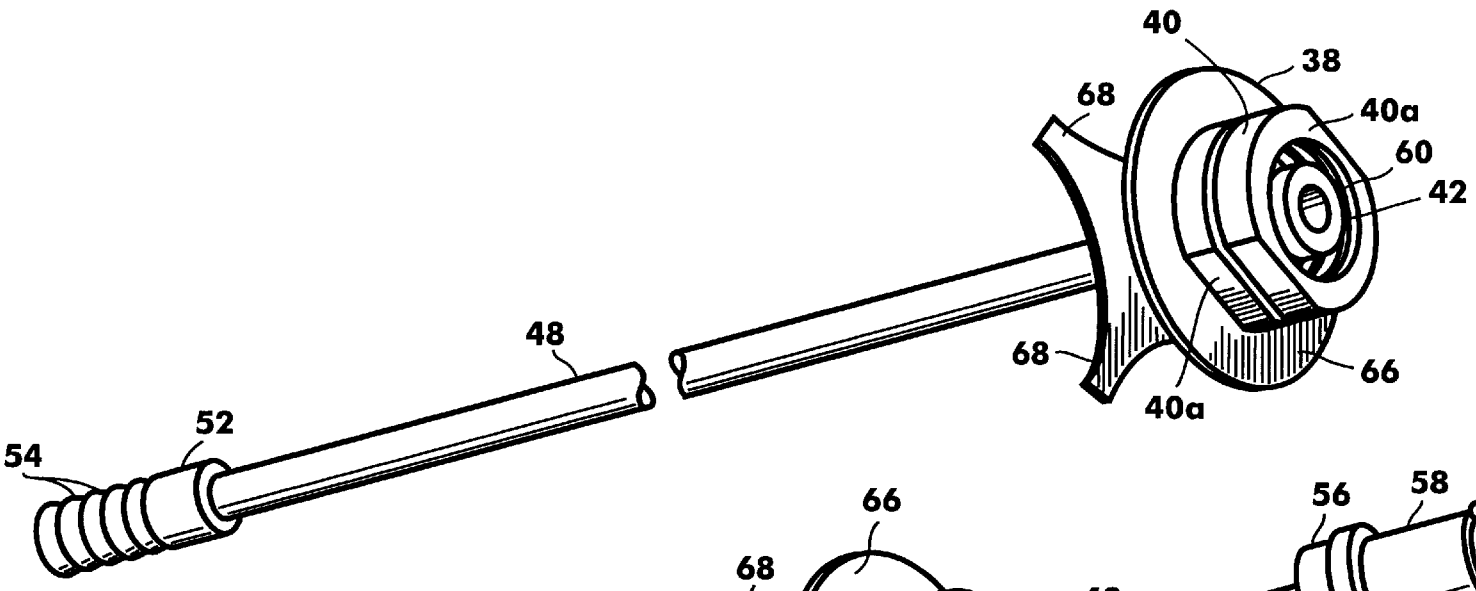
Fig. 4
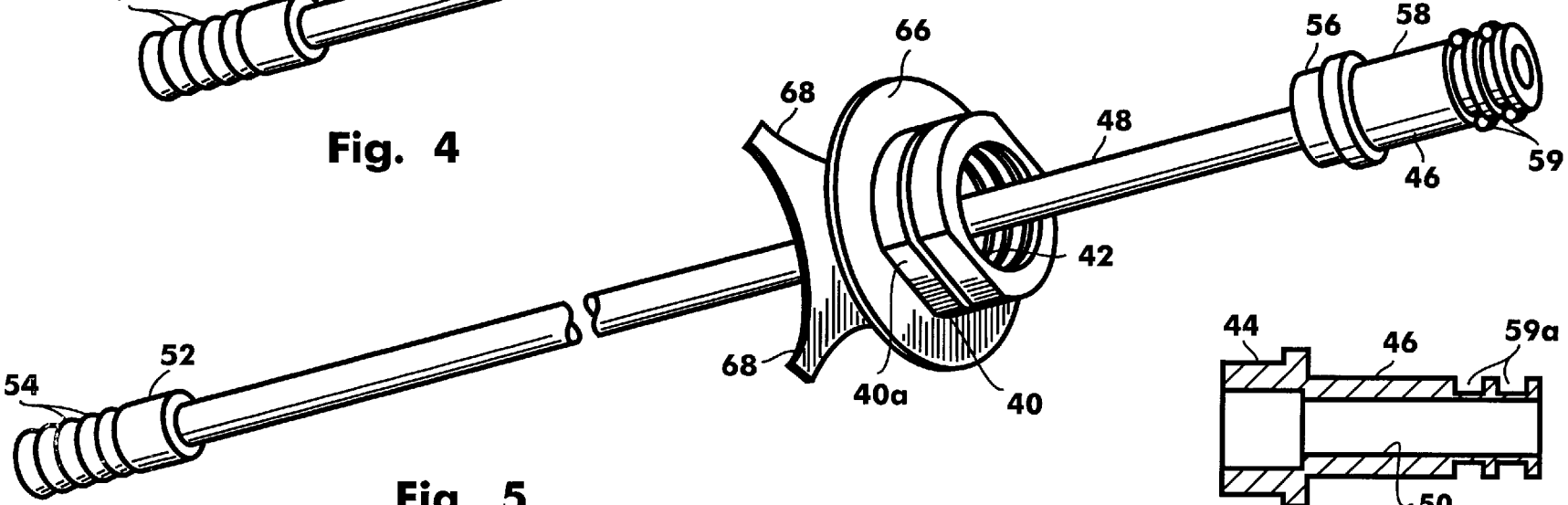
Fig. 5
Fig. 6

BEVERAGE DISPENSING SYSTEM

BACKGROUND OF THE INVENTION

1. Field of the Invention

The present invention relates generally to beverage dispensing systems of the type having a dispensing tower, including a dispensing faucet, a beverage container remote from the faucet and a feed line interconnecting the faucet with the beverage container to permit beverage to flow from the container to the faucet. More particularly, the invention concerns a beverage dispensing system of the character described that includes a connector module receivable within the dispensing tower for interconnecting the faucet with the beverage container. The connector module includes a novel cooling component that can be connected to the feed line and to a refrigeration line for cooling the feed line so as to ensure that the beverage leaving the faucet is appropriately chilled.

2. Discussion of the Prior Art

Many prior art beverage dispensing system of the type used in bars and restaurants have an upstanding, bar mounted dispensing tower, to which one or more dispensing faucets are connected. A beverage container, that is usually located at a remote location from the faucet is interconnected with the faucet by an elongated feed line that permits the beverage to flow from the container to the faucet. Because the proper dispensing of many beverages requires that the beverage be at a proper temperature when it leaves the dispensing faucet some type of cooling means is often provided within the dispensing tower for cooling the feed line. Such cooling is particularly necessary in the dispensing of beer because, when warm draft beer is drawn into a glass, excessive foam is generated. Accordingly, unless considerable time is spent in the dispensing process, incomplete filling of the glasses results. In active beer parlors this time is simply not available. Because of this problem several methods have been suggested for reducing foam generation by cooling the draft beer in the feed line between the faucet and the beer barrel or keg.

In the past, cooling of the feed line was typically accomplished by a refrigeration line charged with a suitable refrigeration fluid that was placed in proximity with the feed line. Although this method resulted in improved cooling it was not entirely satisfactory.

Accordingly, an improved apparatus was suggested to better cool the feed line leading to the dispensing faucet. This apparatus, which is described in U.S. Pat. No. 4,674,296 issued to Renaud, includes a temperature conductive block that is disposed proximate the feed line and includes a channel adapted to receive the refrigeration line. With this construction, the block is cooled by the refrigeration line, which, in turn, cools the feed line. During the beverage dispensing operation, the beer or other liquid before exiting the faucet passes through a cooled zone formed by the conductive block and is at least partially cooled thereby.

The apparatus of the present invention, which comprises a novel connector module that is closely received within the bar mounted dispensing tower, uniquely includes within the module itself cooling means that function to effectively and reliably cool the beverage flowing from the dispensing faucet. More particularly, as will be discussing greater detail hereinafter, disposed within the connector module of the present invention, is a uniquely configured cooling component that is in contact with both the product line carrying the beverage and with the shank to which the dispensing faucet is connected. With this construction, the beverage is continuously cooled until the time it exits the dispensing faucet.

A significant drawback of the prior art dispensing systems that is overcome by the novel apparatus of the present invention, resides in the difficulty in repairing leaks and other malfunctions of the beverage lines and connectors that are mounted within the dispensing tower. Because of the very limited space that exists within the dispensing towers, repair and replacement of beverage lines and connectors is difficult, tedious, and time consuming. Even skilled workmen using special tools have difficulty in accomplishing such major work. The present invention uniquely overcomes these problems by providing a pre-plumbed connector module that can be inserted as a self-contained unit into the conventional beverage dispensing tower to take the place of the originally installed tubing and related connectors.

SUMMARY OF THE INVENTION

It is an object of the present invention to provide a novel connector module for use in connection with a beverage dispensing system for dispensing a beverage from a beverage container that includes a surface mounted dispensing tower to which one or more dispensing faucets are connected. The connector module, which can be operably interconnected with the dispensing faucets, includes a novel cooling component that can be connected to the feed line and to a refrigeration line for cooling the feed line so as to ensure that the beverage leaving the faucet is appropriately chilled.

More particularly, it is an object of the invention to provide a retrofit connector module for interconnecting the beverage container with the dispensing faucets that can be inserted directly into the dispensing tower and take the place of the existing feed lines and cooling means.

Another object of the invention is to provide a retrofit connector module of the character described in the preceding paragraph in which the cooling component and the feed lines are appropriately pre-plumbed so that the connector module can be inserted directly into the dispensing tower and be correctly positioned to enable the feed lines to be quickly and easily interconnected with the dispensing faucets that are normally carried by the dispensing tower.

Another object of the invention is to provide a retrofit connector module of the type described, that includes a module shell that contains the feed lines and the cooling component that can be filled with insulation materials to appropriately insulate the feed lines and the cooling component.

Another object of the invention is to provide a connector module as described in the preceding paragraph in which the cooling component is provided with an anti-rotation head that lockably engages a specially configured opening formed in the module shell so as to prevent rotation of the cooling component and the connector tube during interconnection of the dispensing faucet with the cooling component.

Another object of the invention is to provide a retrofit connector module of the character described in the preceding paragraphs that is of a simple construction and one that can be inexpensively manufactured and easily installed within a conventional draft tower of a beer dispensing system by a relatively unskilled workman using simple tools.

These and other objects of the invention are achieved by the novel apparatus of the invention, the details of construction of which are more fully described in the paragraphs that follow.

BRIEF DESCRIPTION OF THE DRAWINGS

FIG. 4 is a generally perspective view of one form of the cooling component of the present invention shown interconnected with a connector tube assembly that is adapted to be interconnected with the beverage feed line.

FIG. 5 is a generally perspective view similar to FIG. 4, but showing the connector tube assembly in the process of being interconnected with the cooling component.

FIG. 6 is a side-elevational, cross-sectional view of a connector probe that is connected to one end of the connector tube of the apparatus shown in FIGS. 4 and 5.

DESCRIPTION OF THE INVENTION

Figure 1:
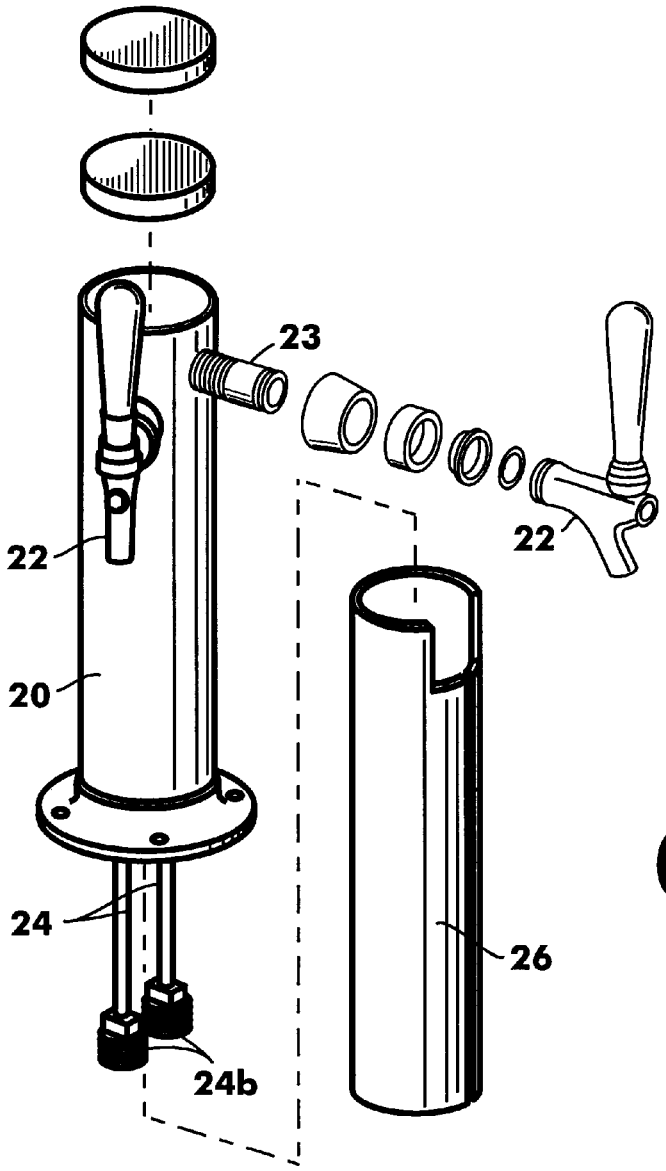
Fig. 1 (Prior Art)
FIG. 1 is a generally perspective, exploded view of a portion of a conventional prior art dispensing system that is of the general character with which one form of the apparatus of the invention can be used.
Figure 2:
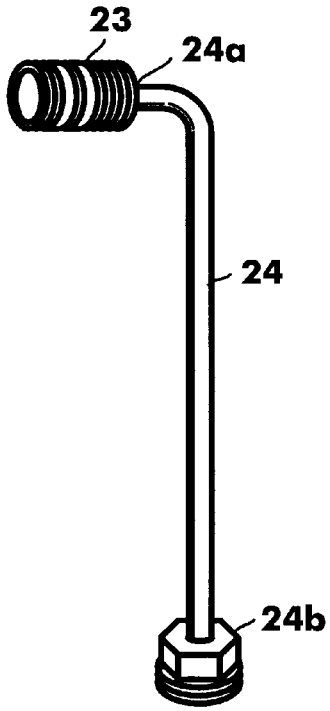
Fig. 2 (Prior Art)
FIG. 2 is a generally perspective view of a prior art product tube which functions to carry the beverage, such a beer, from a remotely located keg to the dispensing faucet.
Figure 3:
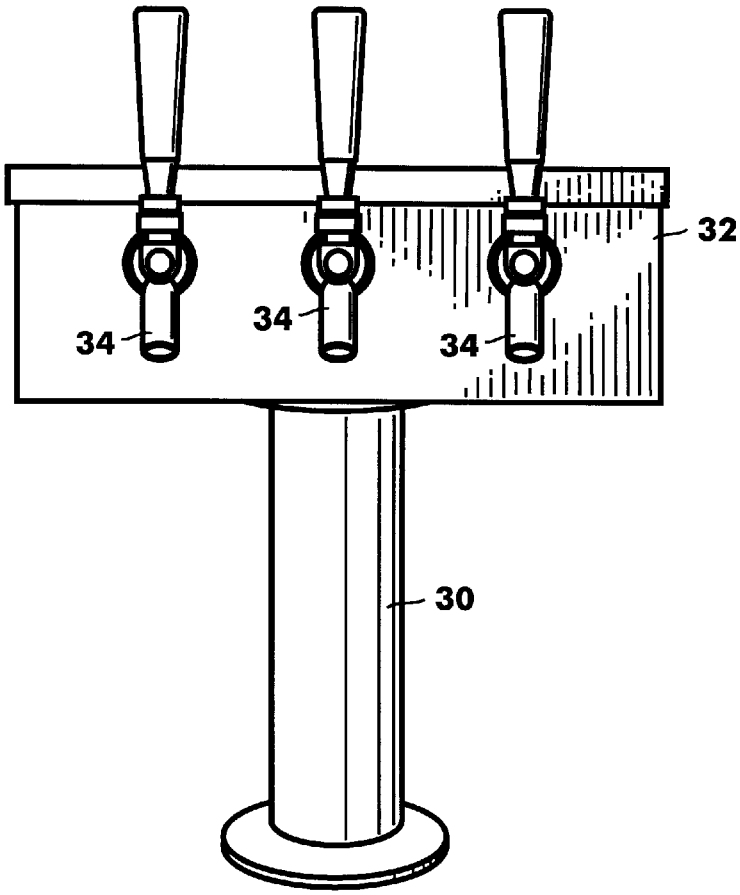
FIG. 3 is a front view of another form of prior art beverage dispensing system with which the apparatus of the invention can be used and showing the dispensing faucets interconnected therewith.

Referring to drawings and particularly to FIGS. 1, 2 and 3, different forms of prior art beverage dispensing systems are there shown. The system shown in FIG. 1 includes a conventional, bar mounted draft tower 20 to which a pair of dispensing faucets 22 can be removably connected by means of threaded connector members 23. Disposed within draft tower 20 is a prior art connector tube 24 of the character shown in FIG. 2 that includes a first end 24*a* and a second end 24*b*. End 24*a* of the connector tube is interconnected with a selected one of the dispensing faucets 22 by means of a threaded connector 23, while end 24*b* is interconnected with a feed line that carries the beverage from a remotely located container to the connector tube. In a typical beer dispensing establishment, draft tower 22 is generally bolted to the top of a bar or a like flat surface and the feed line is connected to a remotely located beer keg.

In the prior art construction shown in FIGS. 1 and 2, the beverage flowing through the connector tube 24 is typically cooled by a refrigeration line (not shown) that extends within the interior of draft tower 20. To assist in maintaining the interior of the draft tower in an appropriately cooled condition, an insulation sleeve 26, which may be of the character shown in FIG. 1, is disposed within draft tower 20.

As previously mentioned, the prior art system shown in FIGS. 1 and 2, when operated in certain environments, fails to cool a beverage such as beer sufficiently to prevent unwanted foaming during the beverage dispensing operation. To improve upon this condition, the prior art system illustrated and described in U.S. Pat. No. 4,674,296 issued to Renaud was developed. The Renaud system includes a cold block having a channel formed therein that is adapted to receive a portion of a refrigeration line. In this way, the cold block is cooled by the refrigeration line which in turn cools the beverage feed line that is interconnected at its upper end with a beverage dispensing faucet.

Another form of prior art beverage dispensing system a shown in FIG. 3. This system also includes an upstanding draft or beverage tower 30 that is typically bolted to a bar or other flat surface. This latter form of prior art beverage dispensing system includes a generally horizontally extending upper housing 32 to which a plurality of dispensing faucets 34 art connected. In the prior art dispensing system the feed lines and refrigeration lines extends upwardly through the tower 30 and are interconnected with the faucets 34 by suitable connectors that are housed within housing 32. If cold blocks are used, such as those described in the Renaud patent, the cold blocks are also housed within housing 32.

As previously mentioned, because of the very limited space that exists quarters within the prior art dispensing towers and associated housings, the repair or replacement of malfunctioning connectors and damaged tubing is extremely difficult and time-consuming. Additionally, the installation and replacement of the dispensing faucets is difficult in the prior art systems because of the difficulty in gripping the connectors that are disposed within the towers or housings while threadably interconnecting the dispensing faucets with the interiorly the mounted connectors. This is another of the problems sought to be overcome by the novel module assembly of the present invention. Because the module assemblies of the invention are completely pre-plumbed before they are installed into the prior art beverage towers or housings, all of the connections can easily and conveniently be made on the workbench. Additionally, because of the novel construction of the module shells or inserts of the connector modules of the invention and because of the novel construction of the cooling component of the invention, rotation of the cooling component within the draft tower during interconnection of the beverage dispensing faucet assembly with the draft tower is positively prevented. More particularly, as will be discussed in greater detail hereinafter, the module inserts of the invention are provided with strategically formed openings that include a pair of oppositely disposed flats that are adapted to be engaged by a pair of oppositely disposed flats formed on the body portion of the cooling component. This unique feature positively prevents rotation of the cooling component within the draft tower or housing during connection of the beverage dispensing faucet assemblies thereto.

Referring next to FIGS. 4 through 6, one form of the uniquely configured cooling component of the invention is there shown and generally designated by the numeral 38. Cooling component 38 is preferably formed from a heat conductive metal such as brass includes a central body portion 40. Central body portion 40 is provided with a first threaded bore 42 that threadably receives the connector shank 23 of the faucet connector means which has the general configuration shown in FIG. 1. The faucet connector means functions to removably interconnect the faucet assembly of the dispensing system with a draft tower, such as that illustrated in FIG. 1 of the drawings, in a manner well understood by those skilled in the art.

Cooling component 40 also includes a second, reduced diameter bore that is coaxially aligned with threaded bore 42 and is strategically sized so as to closely receive the connector or collar portion 44 of a connector probe 46 that is interconnected with an elongated connector tube 48 in the manner best seen in FIG. 5 of the drawings. More particularly, illustrated in FIG. 6 of the drawings, connector probe 46 is provided with an axially bore 50 that closely receives the upper extremity of the connector tube 48. Connector tube 48 can be fixedly interconnected with connector probe by any suitable means such as welding. Disposed proximate the lower extremity of connector tube 48 is a feed line connector means for connecting connector tube 48 to a feed line leading to a remotely located beverage container such as a beer keg. This feed line connector means is here provided in the form of a generally cylindrically shaped connector 52 that includes a plurality of longitudinally spaced apart, circumferentially extending tube gripping protuberances 54.

After connector probe 46 is suitably interconnected with connector tube 48 in the manner shown in FIG. 5, the connector portion 56 of the connector probe can be press fit into the second bore of cooling component 38 to provide the subassembly construction shown in FIG. 4 wherein the body portion 58 of the connector probe extends into internally threaded bore 42 to form an annular shaped opening 60 of the character best seen in FIG. 4. As will later be discussed, connector shank 23 of the faucet connector means is received within annular space 60 at the time of interconnection of the dispensing faucet with the assemblage shown in FIG. 4. In this regard, the shank portion 58 of the connector probe is provided with sealing means for sealably engaging the connector shank 23. This sealing means here comprises a plurality of elastomeric O-rings 59 (FIG. 5) that are received within O-ring grooves 59a formed in shank portion 58 (FIG. 6).

Figure 9:
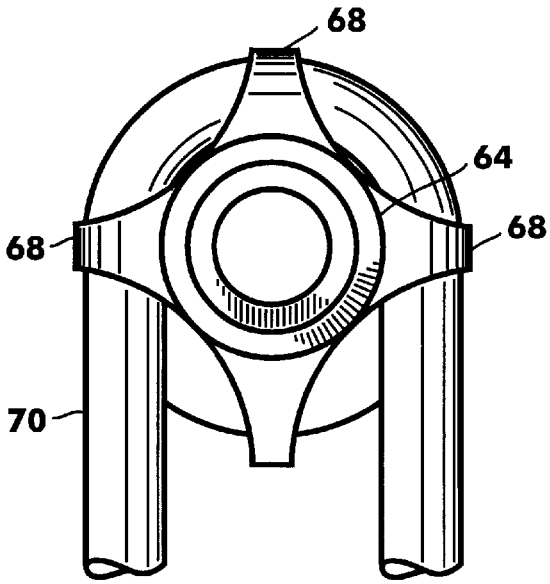
FIG. 9 is a greatly enlarged, fragmentary view of the cooling component of the apparatus of the invention showing the cooling tube through which the refrigerant flows having been coiled about the cooling component.

An important feature of the cooling component 38 of the present form of the invention resides in the provision of a cooling tube receiving groove 64 that circumscribes internally threaded bore 42 in the manner shown in FIG. 9. Groove 64 is bounded by a radially, outwardly extending flange 66 and a plurality of circumferentially spaced, radially outwardly extending locking fingers 68 which function to securely grip the refrigeration line of the dispensing system. As illustrated in FIG. 9, groove 64 closely receives a portion of the refrigeration tube, which is generally identified by the numeral 70. When a single cooling component 38 is used, the refrigeration tube 70 is curved around the cooling component in the manner shown in FIG. 9 and ears 68 are bend around the tube in the manner shown in FIG. 9 to securely hold the refrigeration tube in place within groove 64. When multiple cooling components are used in the manner shown in FIG. 8, the refrigeration tubes 70 are disposed an engagement with cooling components in the manner shown in FIG. 8 and the upper ears 68a are bent over the tubing to again hold it in place. When the cooling components of the invention are used as a part of the connector module assemblies of the invention, they are mounted within the shell-like inserts of the connector modules in the manner shown in FIGS. 8 and 14.

Figure 7:
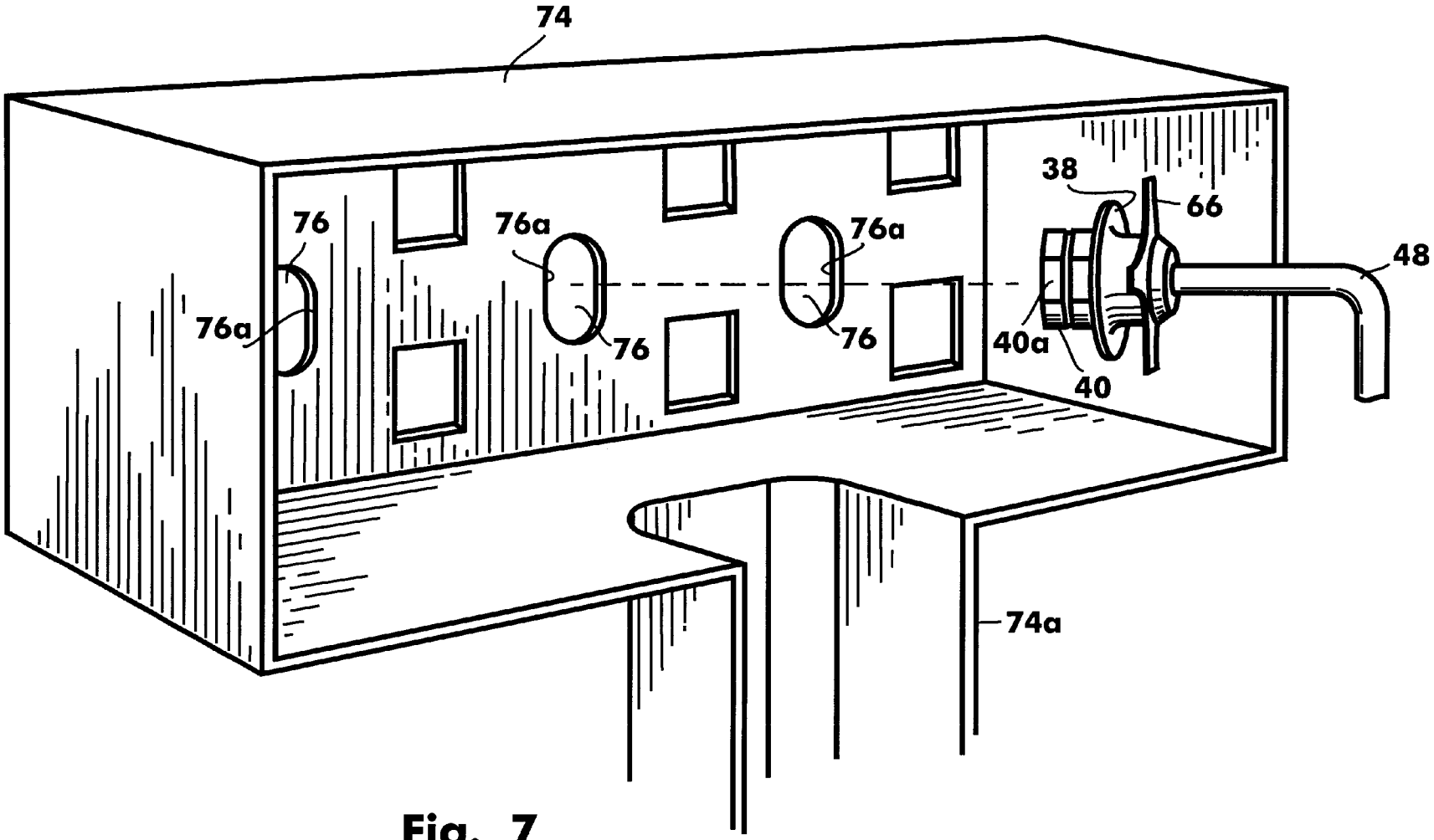
FIG. 7 is a generally perspective, exploded view of one form of the tower insert shell of the apparatus of the invention that can be used with a dispensing unit of the character shown in FIG. 3, showing one of the connector tube assemblies in position to be interconnected with the tower insert shell.
Figure 8:
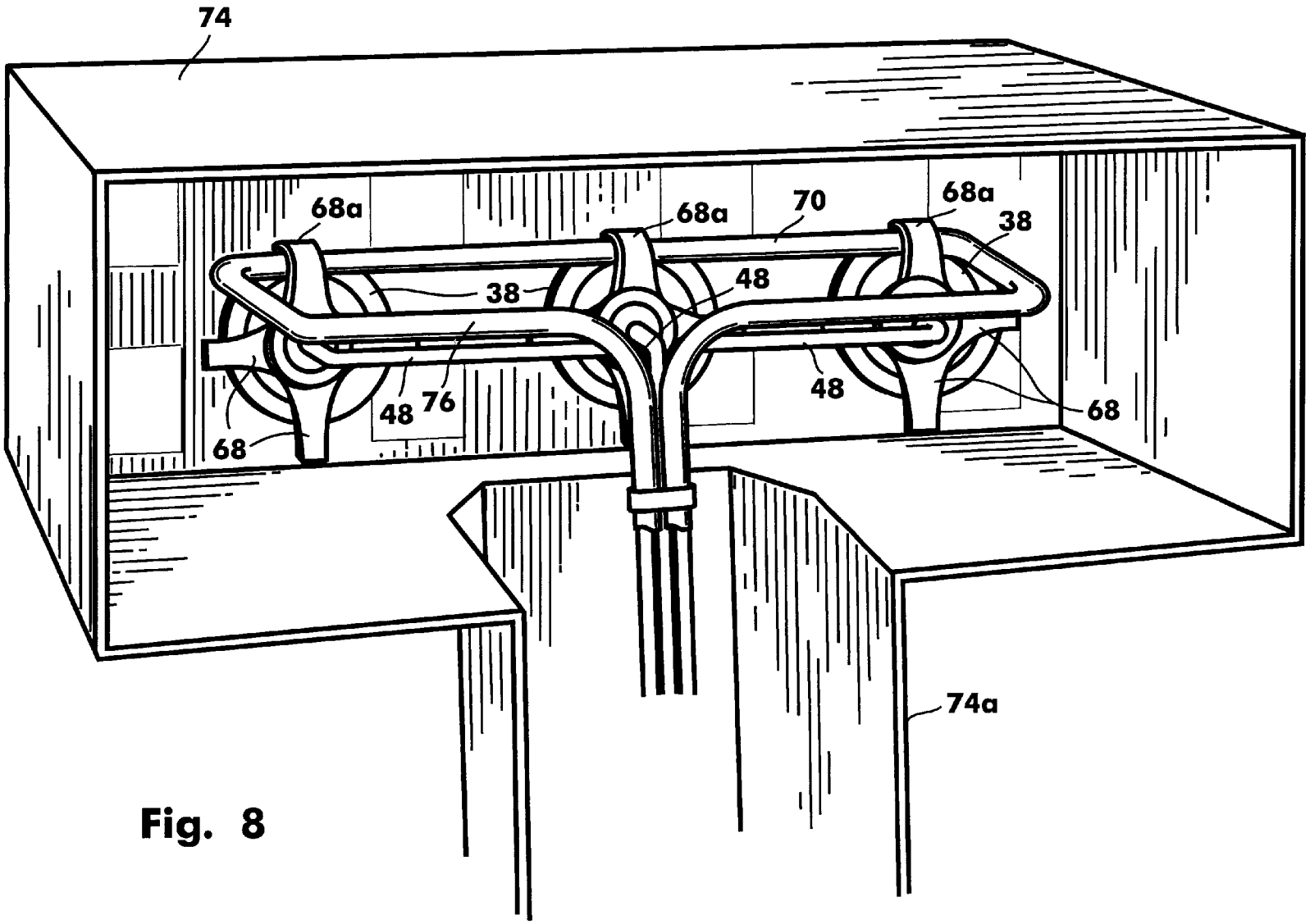
FIG. 8 is a generally perspective view similar to FIG. 7, but showing three of the connector tube assemblies interconnected with the tower insert shell.

Considering now the connector module of the invention that is used in connection with the dispensing tower and housing of the character shown in FIG. 3, the cooling components 38 are mounted within insert shell 74 of the module with the body portions of the cooling components received within the strategically shaped openings 76 formed in the insert 74 (see FIGS. 7 and 8). As best seen in FIG. 7, each of the strategically shaped openings 76 includes a pair of oppositely disposed flats 76*a* that are adapted to be engaged by the pair of oppositely disposed flats 40*a* formed on body portion 40 of each of the cooling components. This unique feature positively prevents rotation of the cooling component within the module insert during connection of the beverage dispensing faucet assemblies to the cooling component.

As previously mentioned, before connection of the beverage dispensing faucet assemblies to the cooling components, the assembly shown in FIG. 8 is constructed on the workbench. More particularly, each of the three cooling components used in the assembly, shown in FIG. 8, are inserted into the openings 76 and the connector tubes 48 are bent in the manner shown in the drawings to permit them to be fed downwardly through the stem portion 74*a* of the insert shell 74. This done, the refrigeration tube 76 is appropriately bent so that a portion thereof extends into the groove formed in the cooling component 38. With the refrigeration tube thusly in place, the top ears 68*a* are bent over the tube in the manner shown in figure 38 to secure the tube in position within the grooves formed in the cooling components 38. As indicated in FIG. 8, the refrigeration tube is bent so that the connector portions thereof extend downwardly through the stem portion 74*a* of insert 74. It is to be noted that the refrigeration tube 76 is disposed in close proximity with the beverage tubes 48 so that in conjunction with the cooling components 38, beverage flowing through the apparatus toward the dispensing faucets is maintained in a cooled condition.

Figure 10:
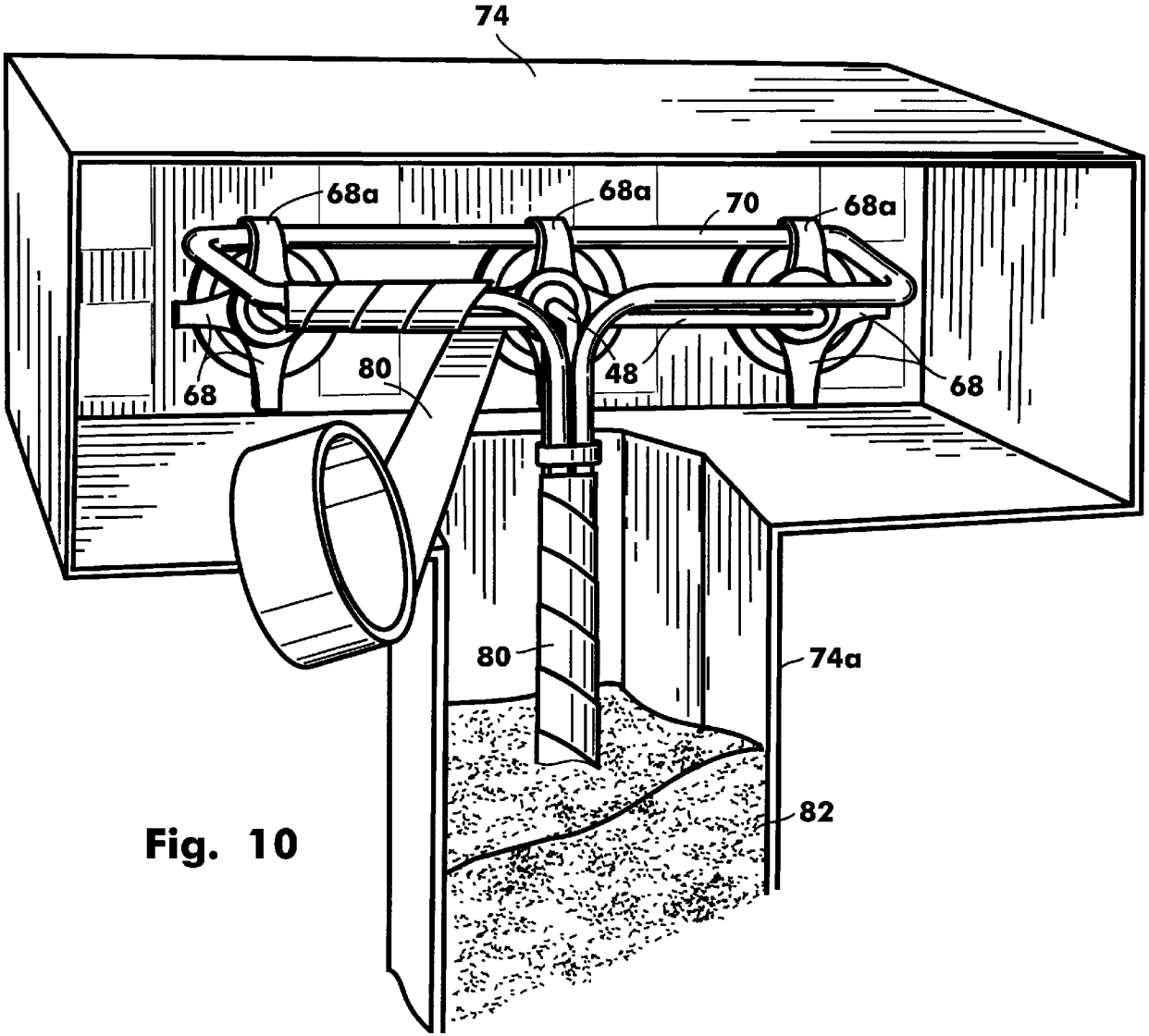
FIG. 10 is a generally perspective view, similar to FIG. 8, but illustrating the step of wrapping the cooling tube assemblages with aluminum or conventional refrigeration tape and filling the body of the tower shell with a foam insulating material.

After the tubing has been bent and interconnected with the cooling components in the manner shown in FIG. 8, the tubing is securely taped in position using a suitable, commercially available aluminum or refrigerator tape 80 such as that shown in FIG. 10 by wrapping the tubing in the manner illustrated in FIG. 10. In this way, the tubing is secured in position so that minimum stress will be exerted upon the connections of the beverage tubing 48 to the cooling components and the connection of the refrigeration tubing to the cooling components.

Figure 11:
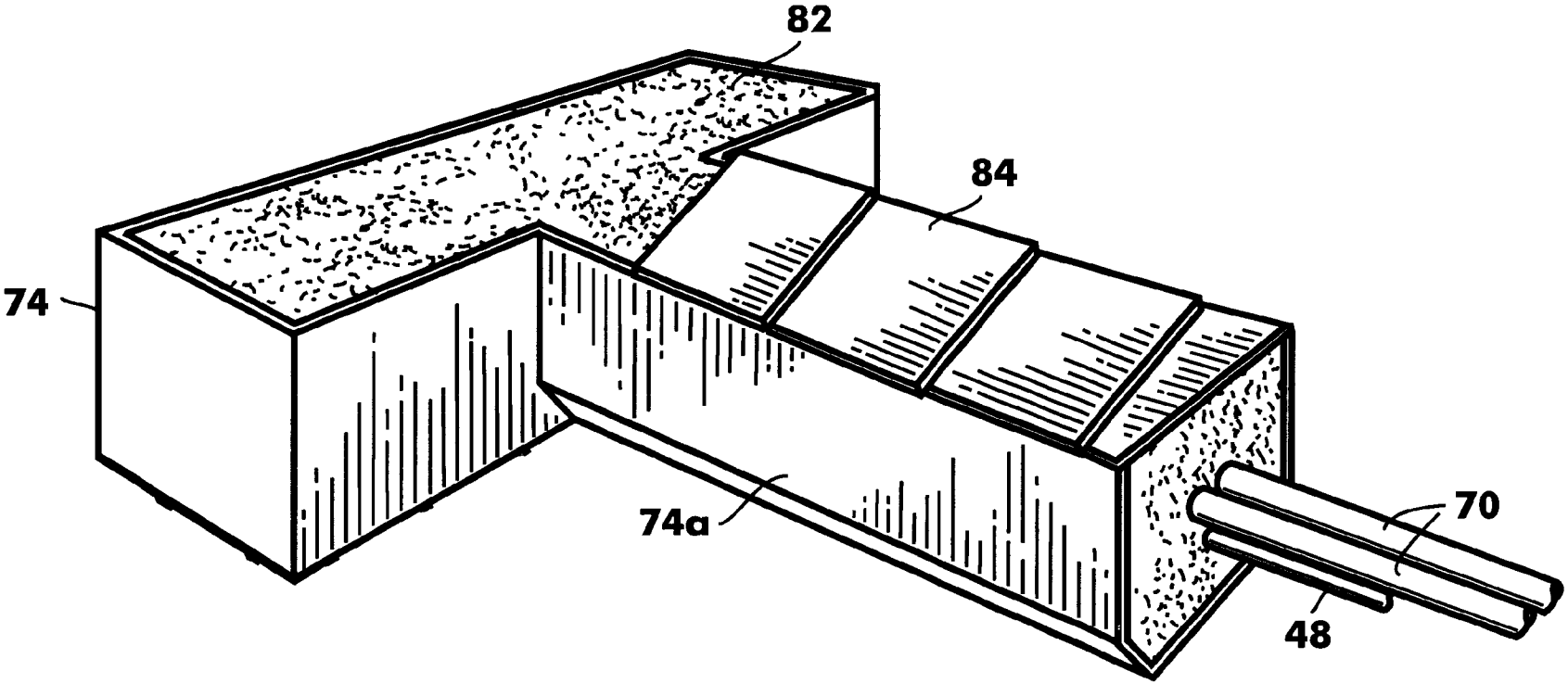
FIG. 11 is a generally perspective view, similar to FIG. 10, but showing the entire tower insert shell filled with insulating foam and being wrapped with a protective tape to form one form of the apparatus of the invention.

After the tubing has been securely taped, insert 74, including stem portion 74*a,* is filled with an insulating foam 82 to completely encapsulate the tubing and the cooling components in the manner indicated in FIG. 11. As illustrated in FIG. 11, the refrigeration tube 70, as well as the connector tubes 48, extend outwardly from stem portion 74*a* for suitable interconnection with the refrigeration unit and with the remotely located beverage container. Preferably the open face of insert 74 is next covered with an adhesive tape 84 to contain the insulation 82 within the housing and to further protect the tubing and cooling connectors from possible damage during the handling and insertion of the connector module into the beverage tower.

Figure 12:
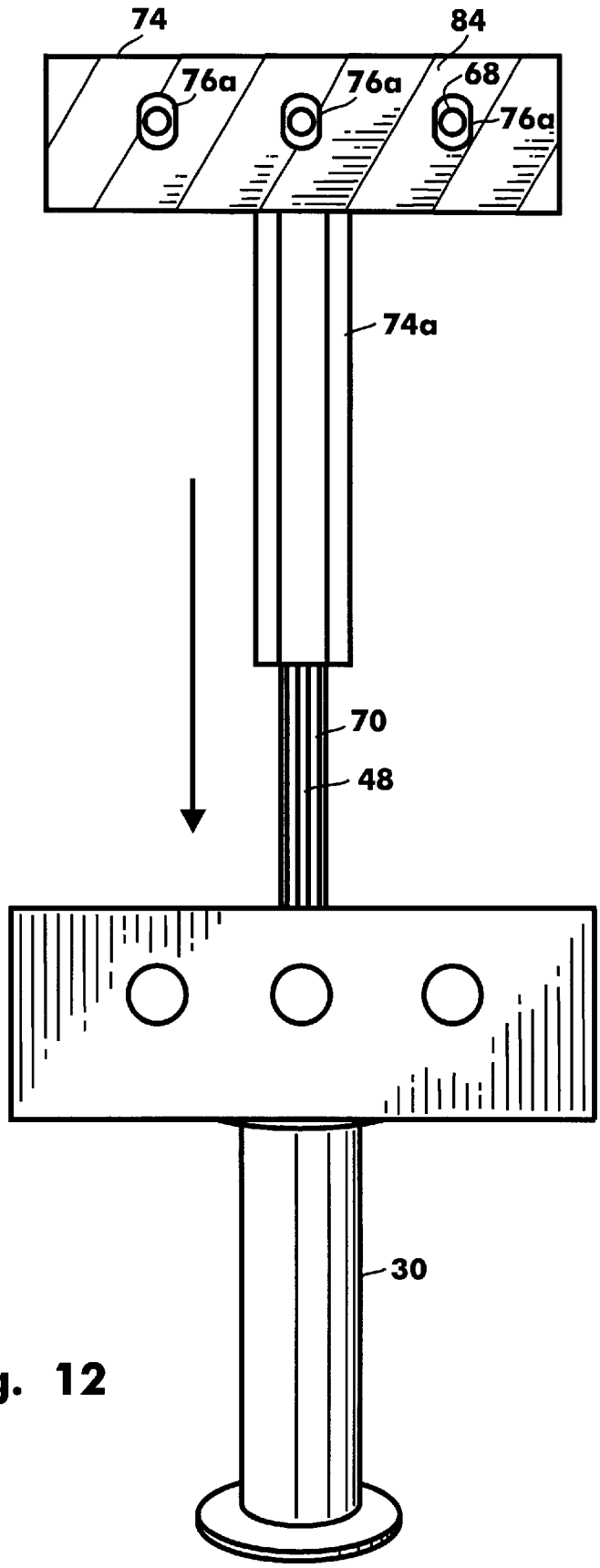
FIG. 12 is a generally illustrative view showing the insertion of the wrapped tower insert shell or retrofit module into the prior art tower.

After the connector module has been completed in the manner described in the preceding paragraphs, the module can be readily inserted into the prior art beverage tower 30 that is of the configuration shown in FIGS. 3 and 12. As indicated in FIG. 12, during the assembly of the connector module to the beverage tower, the refrigeration and connector tubing 76 and 48 is inserted into the tower for appropriate interconnection with the refrigeration unit and with the remotely located beverage container. When the connector module is in position within the prior art beverage tower, the faucets can be interconnected to the cooling components in the manner previously discussed without fear of damage to the tubing due to rotation of the cooling components relative to the housing 74.

Figure 13:
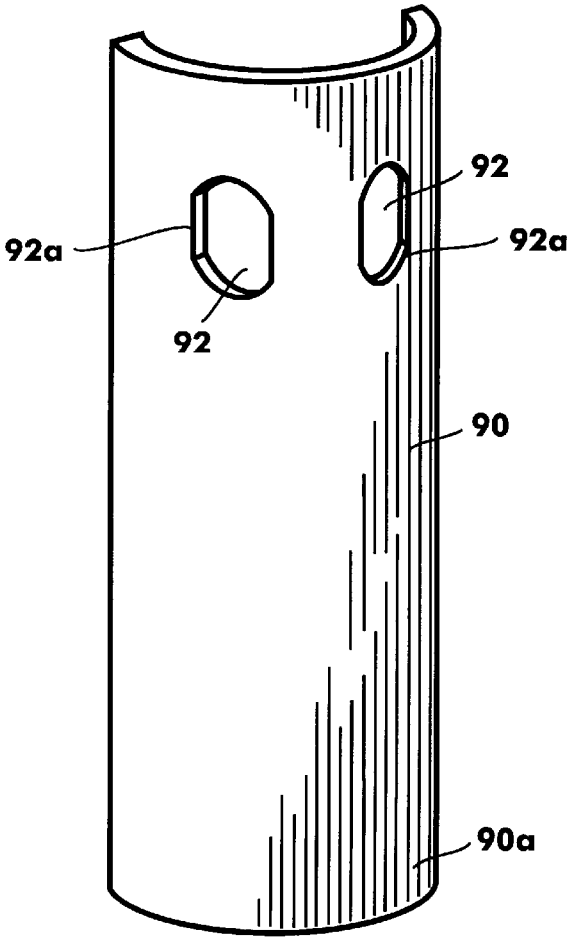
FIG. 13 is a generally perspective view of an alternate form of tower insert shell for use with prior art towers of the general character shown in FIG. 1.
Figure 14:
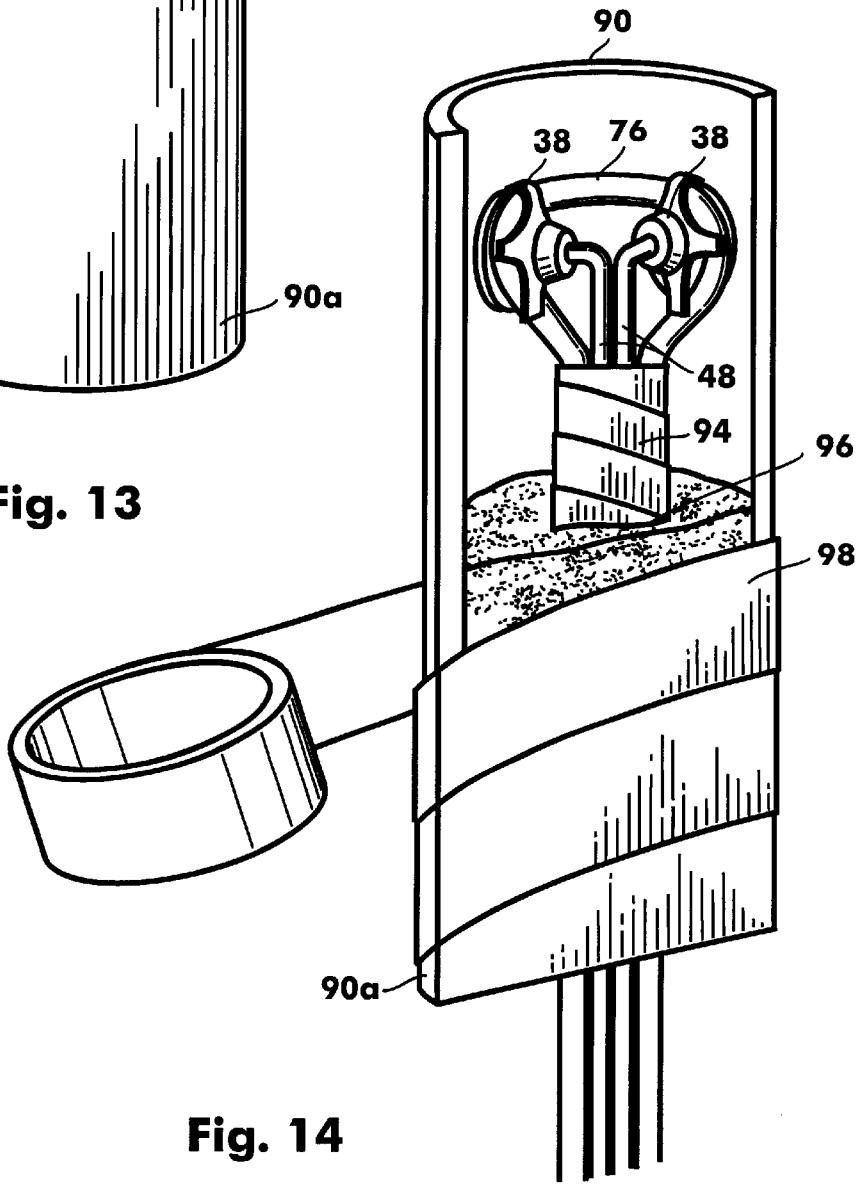
FIG. 14 is a generally perspective view of the tower insert shell shown in FIG. 13 interconnected with the connector tubes and partially filled with a foam material.
Figure 15:
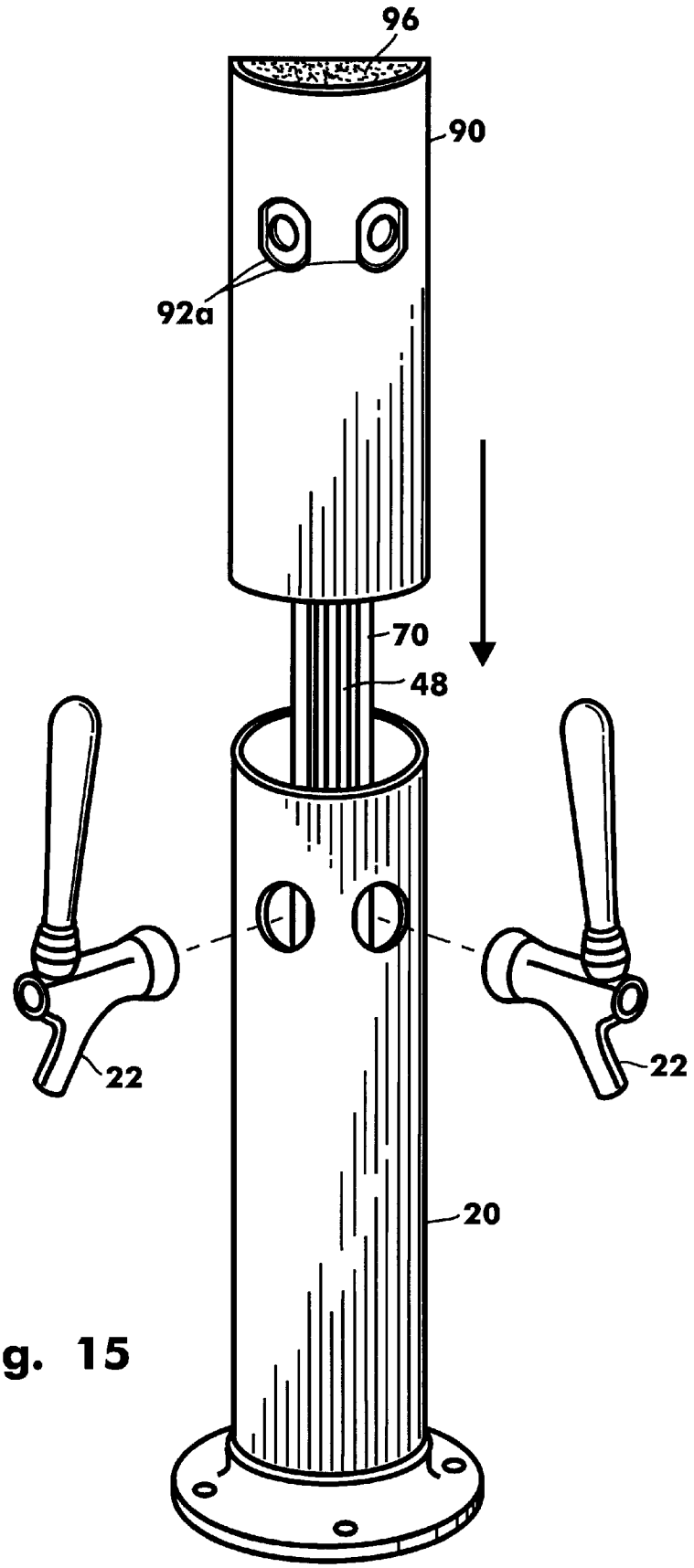
FIG. 15 is a generally perspective, illustrative view showing the insertion of the filled tower insert shell or alternate form of retrofit module into a prior art tower of the alternate design shown in FIG. 1.

Considering next the connector module of the invention that is used in connection with the dispensing tower and housing of the character shown in FIG. 1 of the drawings, in this instance the cooling components 38 are mounted within an insert 90 of the module (FIG. 13). As indicated in FIG. 14, the body portions of the cooling components 38 are here received within strategically shaped openings 92 formed in the insert 74 (see FIG. 13). As best seen in FIG. 13, each of the strategically shaped openings 96 includes a pair of oppositely disposed flats 92a that are adapted to be engaged by the pair of oppositely disposed flats 40*a* formed on body portion 40 of each of the cooling components (see FIG. 14). As before, this unique feature positively prevents rotation of the cooling component within the module insert during connection of the beverage dispensing faucet assemblies to the cooling component.

As was the case in the earlier described embodiment of the invention, before connection of the beverage dispensing faucet assemblies to the cooling components, the assembly shown in FIG. 14 is constructed on the workbench. More particularly, each of the two cooling components used in the assembly, shown in FIG. 14, are inserted into the openings 92 and the connector tubes 48 are bent in the manner shown in FIG. 14 to permit them to be fed downwardly through the lower portion 90*a* of the insert or shell 90. This done, the refrigeration tube 76 is appropriately bent so that a portion thereof extends into the groove formed in the cooling component 38. With the refrigeration tube thusly in place, the top and side ears 68 are bent over the tube in the manner shown in FIG. 14 to secure the tube in position within the grooves formed in the cooling components 38. As indicated in FIG. 14, the refrigeration tube is bent so that the connector portions thereof extend downwardly through the insert in the manner shown. As before, refrigeration tube 76 is disposed in close proximity with the beverage tubes 48 so that in conjunction with the cooling components 38, beverage flowing through the apparatus toward the dispensing faucets is maintained in a cooled condition.

After the tubing has been bent and interconnected with the cooling components in the manner shown in FIG. 14, the tubing is securely taped in position using a suitable, commercially available aluminum or refrigerator tape 94 such as that shown in FIG. 14 by wrapping the tubing in the manner illustrated in FIG. 14. In this way, the tubing is secured in position so that minimum stress will be exerted upon the connections of the beverage tubing 48 to the cooling components and the connection of the refrigeration tubing 76 to the cooling components.

After the tubing has been securely taped, insert 74, is filled with an insulating foam 96 to completely encapsulate the tubing and the cooling components in the manner indicated in FIG. 14. As illustrated in FIG. 14, the refrigeration tube 76, as well as the connector tubes 48, extend outwardly from the lower portion of the insert for suitable interconnection with the refrigeration unit and with the remotely located beverage container. Preferably, at least the open face of insert 90 is next covered with an adhesive tape 98 to contain the insulation 96 within the housing and to further protect the tubing and cooling connectors from possible damage during the handling and insertion of the connector module into the beverage tower.

After the connector module of this latest form of the invention has been completed, the module can be readily inserted into the open top of the prior art beverage tower 20 that is of the configuration shown in FIG. 1. During the assembly of the connector module to the beverage tower 20, the refrigeration and connector tubing 76 and 48 is fed through the hollow tower for appropriate interconnection with the refrigeration unit and with the remotely located beverage container. When the connector module is in position within the prior art beverage tower 20, the faucets can be interconnected to the cooling components in the manner previously discussed.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for use with a beverage dispensing system having a surface-mounted dispensing tower having a shank-receiving opening therein; a dispensing faucet connected to the dispensing tower and including a connector shank receivable with the shank-receiving opening, a remote beverage container, a feed line connected to the beverage container and a cooling tube through which a refrigerant flows, the apparatus comprising a connector module for interconnecting the feed line with the faucet, said connector module comprising:

(a) an insert receivable within the hollow housing of the dispensing tower, said insert having an opening therein arranged to align with the shank-receiving opening in the hollow housing;

(b) a cooling component connected to said insert, said cooling component including body portion having a first threaded bore and a cooling tube receiving groove, said body portion being receivable within said opening in said insert;

(c) a connector probe connected to said cooling component and extending outwardly therefrom; and (d) a connector tube having a first end connected to said connector probe, a body portion extending through said first threaded bore of said cooling component and a second end connected to the feed line.

2. The apparatus as defined in claim 1 in which said body portion of said cooling component further includes a first end portion provided with a pair of oppositely disposed flats.

3. The apparatus as defined in claim 2 in which said opening in said insert includes a pair of oppositely disposed flats arranged to be engaged by said flats of said body portion of said cooling component.

4. The apparatus as defined in claim 2 in which said cooling component further includes a second reduced diameter bore coaxially aligned with said first threaded bore and in which said connector probe includes a connector portion closely received within said second bore.

5. The apparatus as defined in claim 2, further including connector means for connecting the faucet to said cooling component and in which said connector probe includes sealing means for sealably engaging said connector means.

6. The apparatus as defined in claim 2 in which said cooling component further includes at least one outwardly extending locking finger for locking the cooling tube within said cooling tube receiving groove.

7. The apparatus as defined in claim 2 further including feed line connector means provided proximate said second end of said connector tube for connecting said connector tube to the feed line.

8. A connector module for use with a beverage dispensing system having a surface-mounted dispensing tower having a shank-receiving opening therein; a dispensing faucet connected to the dispensing tower and including a connector shank receivable with the shank-receiving opening, a remote beverage container, a feed line connected to the beverage container and a cooling tube through which a refrigerant flows, said connector module functioning to connect the feed line with the faucet and comprising:

(a) an insert shell receivable within the hollow housing of the dispensing tower, said insert shell having an opening therein arranged to align with the shank-receiving opening in the hollow housing;

(b) a cooling component connected to said insert shell, said cooling component including body portion having a pair of spaced-apart flats, a first threaded bore and a cooling tube receiving groove, said body portion being receivable within said opening in said insert shell;

(c) a connector probe connected to said cooling component and extending outwardly therefrom; and (d) a connector tube having a first end connected to said connector probe, a body portion extending through said first threaded bore of said cooling component and a second end connected to the feed line.

9. The connector module defined in claim 8 in which said opening in said insert shell includes a pair of oppositely disposed flats arranged to be engaged by said flats of said body portion of said cooling component.

10. The connector module as defined in claim 8 in which said cooling component further includes a second reduced diameter bore coaxially aligned with said first threaded bore and in which said connector probe includes a connector portion closely received within said second bore.

11. The connector module as defined in claim 8, in which said cooling component further includes at least one outwardly extending locking finger for locking the cooling tube within said cooling tube receiving groove.

12. The apparatus as defined in claim 11 further including feed line connector means provided proximate said second end of said connector tube for connecting said connector tube to the feed line.

13. A connector module for use with a beverage dispensing system having a surface-mounted dispensing tower having a shank-receiving opening therein; a dispensing faucet connected to the dispensing tower and including a connector shank receivable with the shank-receiving opening, a remote beverage container, a feed line connected to the beverage container and a cooling tube through which a refrigerant flows, said connector module functioning to connect the feed line with the faucet and comprising:

(a) an insert shell receivable within the hollow housing of the dispensing tower, said insert shell having an opening therein arranged to align with the shank-receiving opening in the hollow housing, said opening in said insert shell having a pair of oppositely disposed flats;

(b) a cooling component connected to said insert shell, said cooling component including body portion at least partially receivable within said opening in said inset shell, said body portion comprising: and (i) a pair of oppositely disposed flats alignable with said pair of oppositely disposed flats of said opening in said insert shell;

(ii) a first threaded bore;

(iii) a second reduced diameter bore coaxially aligned with said first threaded bore; and (iv) a cooling tube receiving groove at least partially circumscribing said first threaded bore;

(c) a connector probe connected to said cooling component and extending outwardly therefrom; and (d) a connector tube having a first end connected to said connector probe, a body portion extending through said first threaded bore of said cooling component and a second end connected to the feed line.

14. The connector module as defined in claim 13, in which said cooling component further includes a plurality of outwardly extending locking fingers for locking the cooling tube within said cooling tube receiving groove.

15. The apparatus as defined in claim 14, further including feed line connector means provided proximate said second end of said connector tube for connecting said connector tube to the feed line.

16. The apparatus as defined in claim 15 in which said connector probe includes a shank portion and sealing means provided on said shank portion for sealably engaging the connector shank of the dispensing system.

17. The apparatus as defined in claim 16 in which said sealing means comprises at least one elastomeric O-ring circumscribing said shank portion of said connector probe.

* * * * *